US010242831B2

(12) United States Patent
Gottschalk et al.

(10) Patent No.: US 10,242,831 B2
(45) Date of Patent: Mar. 26, 2019

(54) ELECTRICAL SWITCHING APPARATUS AND SHUNT TAB ASSEMBLY THEREFOR

(71) Applicant: EATON CORPORATION, Cleveland, OH (US)

(72) Inventors: Andrew Lawrence Gottschalk, Monaca, PA (US); Brian John Schaltenbrand, Pittsburgh, PA (US); Bradley P. Rizzo, Bethel Park, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 177 days.

(21) Appl. No.: 15/376,962

(22) Filed: Dec. 13, 2016

(65) Prior Publication Data

US 2018/0166241 A1 Jun. 14, 2018

(51) Int. Cl.

| | |
|---|---|
| ***H01H 33/02*** | (2006.01) |
| ***H01H 71/08*** | (2006.01) |
| ***H01H 71/02*** | (2006.01) |
| ***H01H 1/58*** | (2006.01) |

(52) U.S. Cl.

CPC ..... *H01H 71/082* (2013.01); *H01H 1/5822* (2013.01); *H01H 71/0207* (2013.01); *H01H 71/0214* (2013.01); *H01H 71/08* (2013.01); *H01H 2001/5827* (2013.01); *H01H 2071/086* (2013.01)

(58) Field of Classification Search

CPC ..... H01H 71/082; H01H 71/0207; H01H 71/0214; H01H 71/08; H01H 71/086; H01H 1/5822; H01H 2001/5827

USPC ..... 200/237

See application file for complete search history.

(56) References Cited

U.S. PATENT DOCUMENTS 4,080,582 A * 3/1978 Link ..... H01H 71/40 335/37
4,527,027 A 7/1985 Link et al.
5,223,681 A * 6/1993 Buehler ..... H01H 71/504 218/22
2003/0222739 A1 12/2003 Kolberg et al.

FOREIGN PATENT DOCUMENTS

WO 2014/204604 A1 12/2014

OTHER PUBLICATIONS

European Patent Office, "Extended European Search Report" (corresp. to EP 17205301.9), dated May 2, 2018, 6 pp.

* cited by examiner

*Primary Examiner* — Anthony R Jimenez
(74) *Attorney, Agent, or Firm* — Eckert Seamans

(57) ABSTRACT

A shunt tab assembly is for an electrical switching apparatus, such as a circuit breaker. The electrical switching apparatus includes a housing, separable contacts enclosed by the housing, an operating mechanism for opening and closing the separable contacts, and a number of shunts. The operating mechanism includes a trip unit. The shunt tab assembly includes a shunt tab structured to be electrically connected to the shunts, a biasing element structured to bias the shunt tab toward a predetermined position with respect to the housing, and a fastener structured to mechanically couple and electrically connect the trip unit to the shunt tab.

16 Claims, 5 Drawing Sheets

ELECTRICAL SWITCHING APPARATUS AND SHUNT TAB ASSEMBLY THEREFOR

BACKGROUND

Field

The disclosed concept relates generally to electrical switching apparatus and, more particularly, to electrical switching apparatus, such as circuit breakers. The disclosed concept also relates to shunt tab assemblies for electrical switching apparatus.

Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism, which opens electrical contact assemblies to interrupt the flow of current through the conductors of an electrical system in response to such fault conditions as detected, for example, by a trip unit. The electrical contact assemblies include stationary electrical contacts and corresponding movable electrical contacts disposed on movable contact arms that pivot to move the movable electrical contacts into and out of electrical contact with the stationary electrical contacts.

Some circuit breaker designs employ a trip unit that is mechanically coupled (e.g., bolted) and electrically connected in parallel to the base of the circuit breaker. For example, each movable contact arm may be electrically connected to a block of copper or shunt tab by a number of flexible conductors, commonly referred to as shunts. Terminals of the trip unit may be bolted to the blocks of copper or shunt tabs. Additional fasteners (e.g., mounting screws) may be used to fasten the blocks of copper or shunt tabs to the base of the circuit breaker to maintain the shunt tabs in the desired position with respect to the circuit breaker housing. Dielectric issues can result due to limited available space and close proximity of electrically conductive components, such as the aforementioned mounting screws and bolts. Additionally, machining (e.g., threading or tapping) the blocks of copper or shunt tabs to receive the mounting screws and/or bolts can be expensive, and the tapped threads can be susceptible to damage and may lack the desired mechanical connection strength.

There is, therefore, room for improvement in electrical switching apparatus, and in shunt tab assemblies therefor.

SUMMARY

These needs and others are met by embodiments of the disclosed concept, which are directed to a shunt tab assembly for an electrical switching apparatus such as, for example, a circuit breaker, which among other benefits satisfies dielectric testing criteria and provides a strong trip unit connection joint.

In accordance with an aspect of the disclosed concept, a shunt tab assembly is provided for an electrical switching apparatus. The electrical switching apparatus includes a housing, separable contacts enclosed by the housing, an operating mechanism for opening and closing the separable contacts, and a number of shunts. The operating mechanism includes a trip unit. The shunt tab assembly comprises: a shunt tab structured to be electrically connected to the shunts; a biasing element structured to bias the shunt tab toward a predetermined position with respect to the housing; and a fastener structured to mechanically couple and electrically connect the trip unit to the shunt tab.

The biasing element may be a leaf spring. The leaf spring may be structured to cooperate with the housing of the electrical switching apparatus to bias the shunt tab toward the predetermined position.

The shunt tab may be a single piece electrically conductive member comprising an exterior, an interior, and a cavity extending from the exterior to the interior.

The fastener may comprise a mounting bolt and a corresponding nut, and the nut may be retained within the cavity. The mounting bolt may extend from the exterior of the shunt tab to the interior of the shunt tab to engage the nut.

An electrical switching apparatus employing at least one of the aforementioned shunt tab assemblies is also disclosed.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
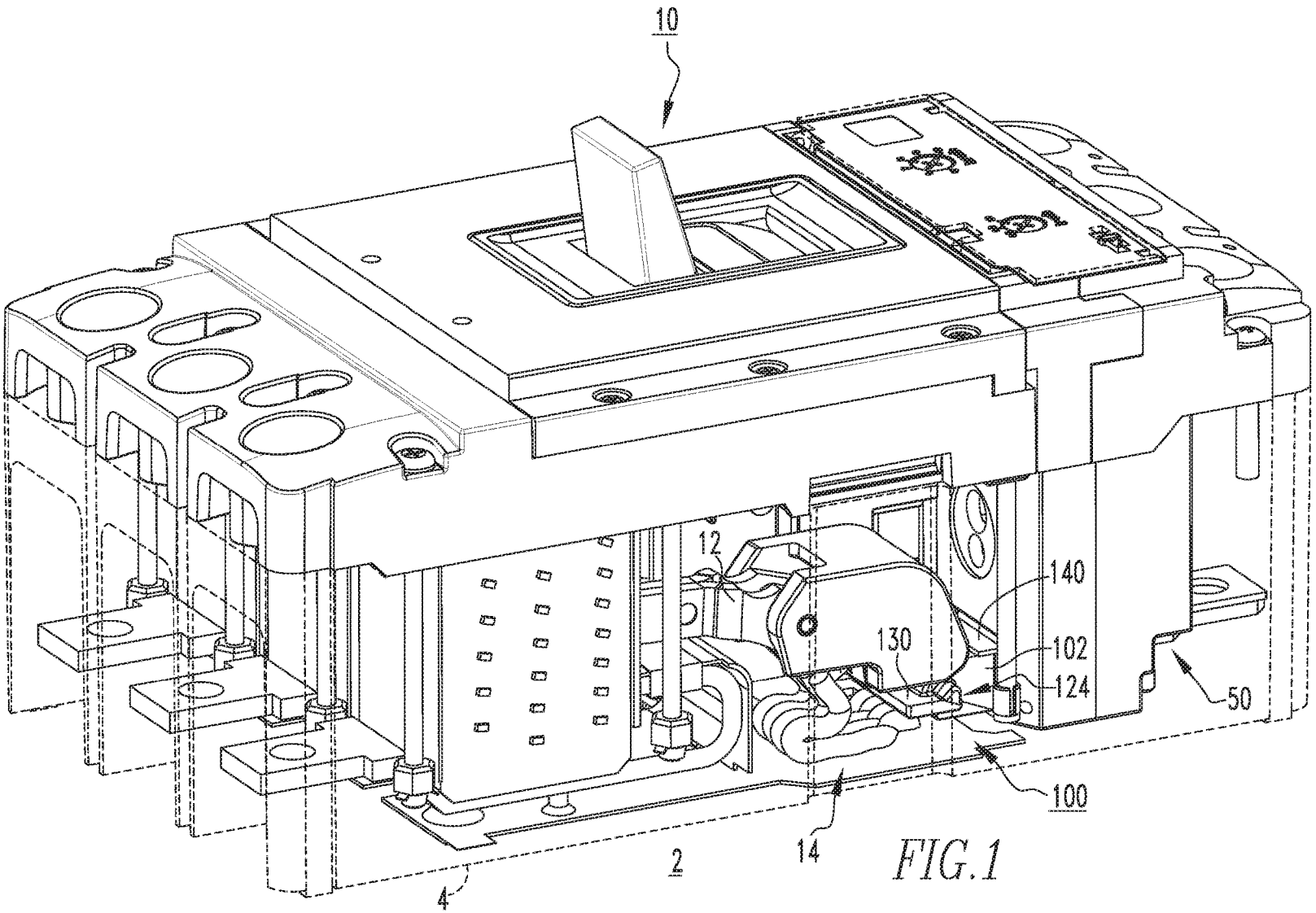
FIG. 1 is a top isometric view of a circuit breaker and shunt tab assembly therefor, in accordance with an embodiment of the disclosed concept, with a portion of the circuit breaker housing shown in hidden line drawing to show internal structures.

The disclosed concept may take form in various components and arrangements of components, and in various techniques, methods, or procedures and arrangements of steps. The referenced drawings are only for the purpose of illustrated embodiments, and are not to be construed as limiting the present invention. Various inventive features are described below that can each be used independently of one another or in combination with other features.

Directional phrases used herein, such as, for example, front, back, top, bottom, upward, downward, and derivatives thereof, relate to the orientation of the elements shown in the drawings and are not limiting upon the claims unless expressly recited therein.

As employed herein, the singular form of "a", "an", and "the" include plural references unless the context clearly dictates otherwise. Still further, as used herein, the term "number" shall mean one or an integer greater than one (e.g., a plurality).

As employed herein, the term "coupled" shall mean that two or more parts are joined together directly or joined through one or more intermediate parts. Furthermore, as employed herein, the phrases "directly connected" shall mean that two or more parts are joined together directly, without any intermediate parts being disposed therebetween at the point or location of the connection.

As employed herein, the phrase "electrically connected" shall mean that two or more parts or components are joined together either directly or joined through one or more intermediate parts such that electricity, current, voltage, and/or energy is operable to flow from one part or component to the other part or component, and vice versa.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

FIG. 1 shows a shunt tab assembly 100 for an electrical switching apparatus 2, such as for example and without limitation, a circuit breaker, in accordance with a non-limiting example embodiment of the disclosed concept. In the example of FIG. 1, the circuit breaker 2 includes a housing 4, which is partially shown in hidden line drawing to show internal components that would otherwise be hidden (see also FIG. 2 partially showing housing 4 in hidden line drawing to show internal components). The circuit breaker 2 further includes separable contacts 6,8 (both shown in simplified form in FIG. 5; see also movable contact 8 disposed on movable contact arm 12 in the exploded view of FIG. 3). The separable contacts 6,8 are enclosed by the housing 4. The circuit breaker 2 also includes an operating mechanism 10 (shown in simplified form in FIG. 5) for opening and closing the separable contacts 6,8, and a number of shunts 14 (four shunts 14 are shown in the non-limiting example of FIG. 1). Comparing FIGS. 1 and 2, it will be appreciated that the non-limiting example circuit breaker 2 is of the variety that accommodates a removable trip unit 50 (shown installed in FIG. 1 and removed in FIG. 2), which cooperates with the operating mechanism 10 to trip open the separable contacts 6,8, for example, in response to a fault condition, in a generally well known manner.

Figure 2:
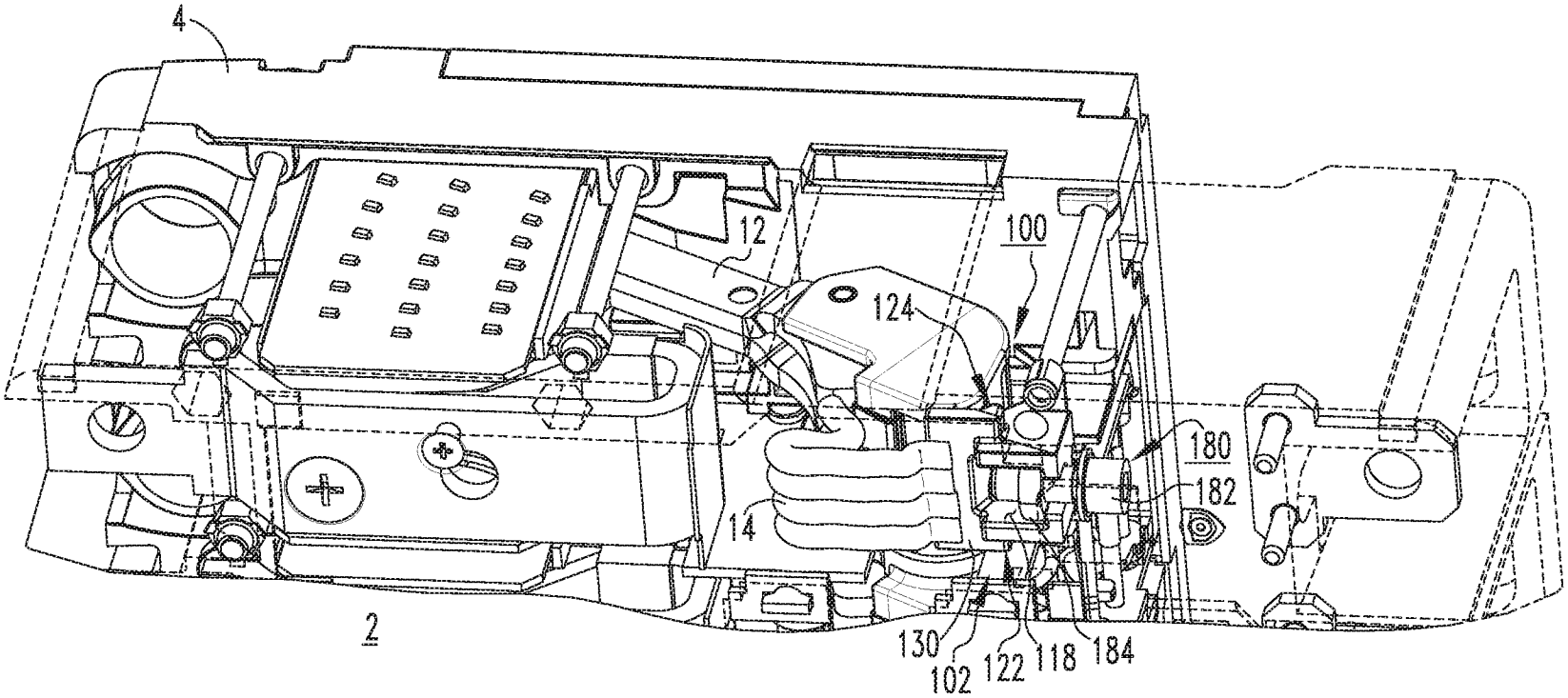
FIG. 2 is a bottom isometric view of a portion of the circuit breaker and shunt tab assembly therefor of FIG. 1.
Figure 3:
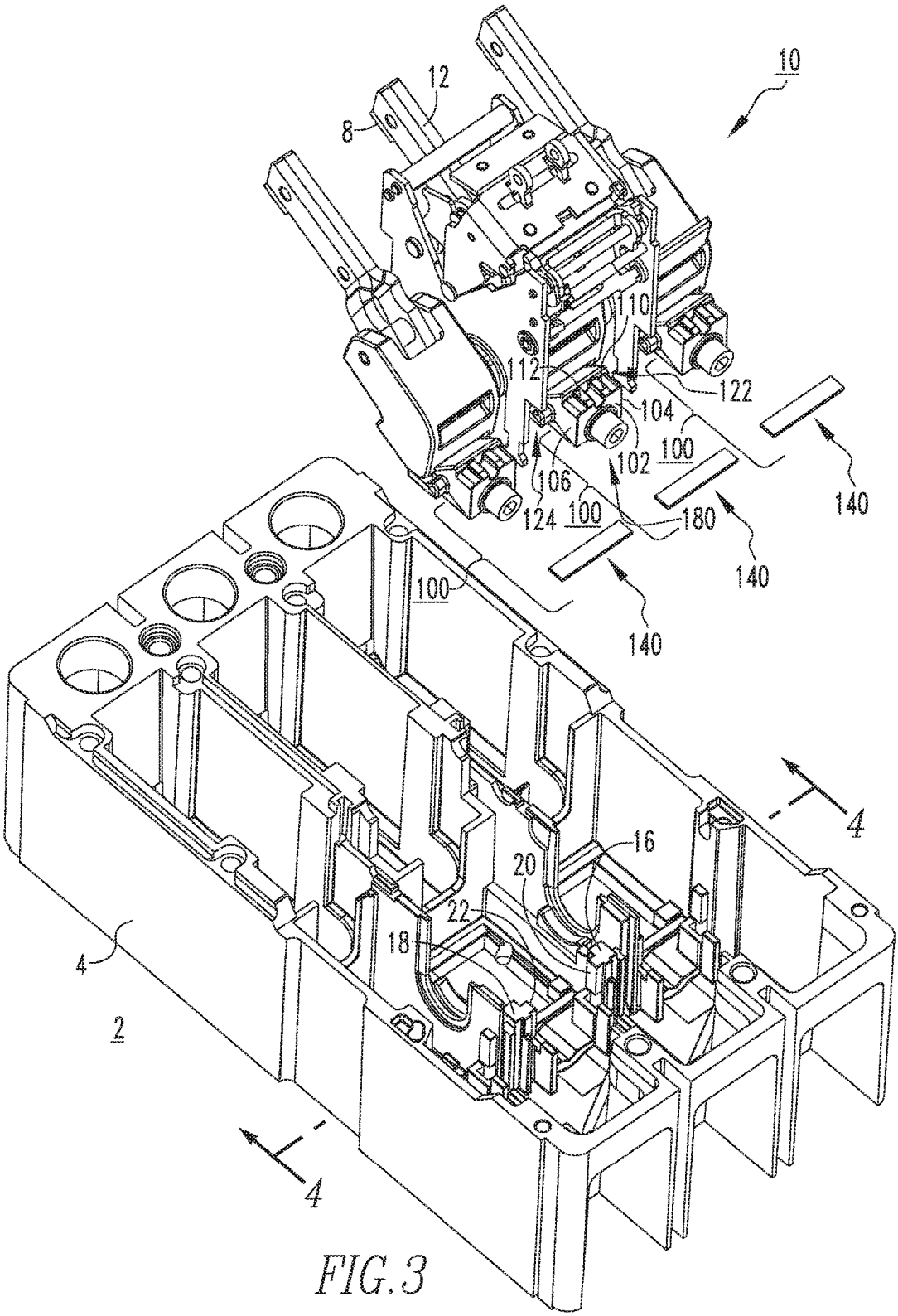
FIG. 3 is an exploded top isometric view of portions of the circuit breaker and shunt tab assembly therefor of FIG. 2.
Figure 4:
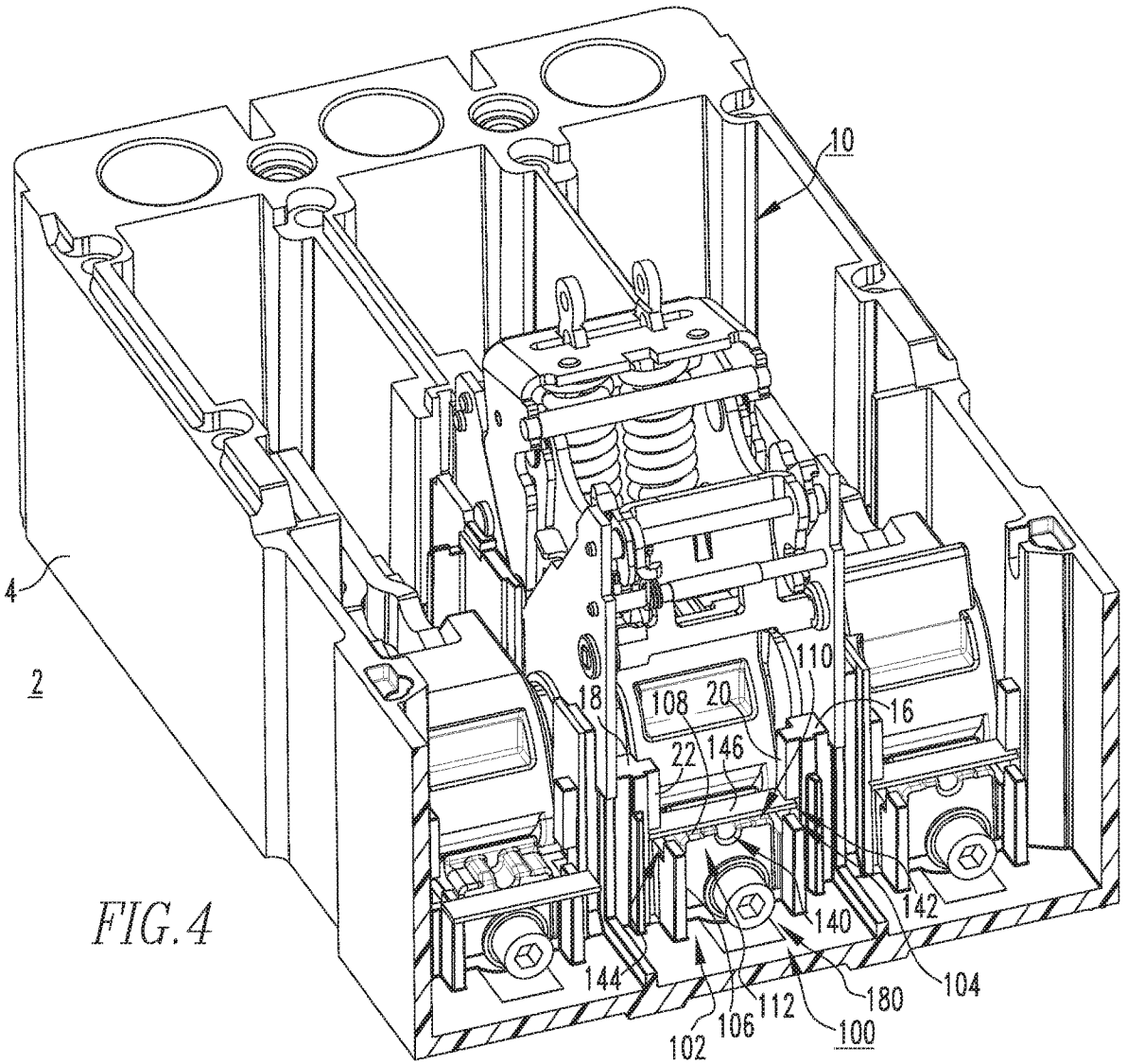
FIG. 4 is an isometric section view taken along line 4-4 of FIG. 3, and showing the circuit breaker and shunt tab assembly therefor assembled.
Figure 5:
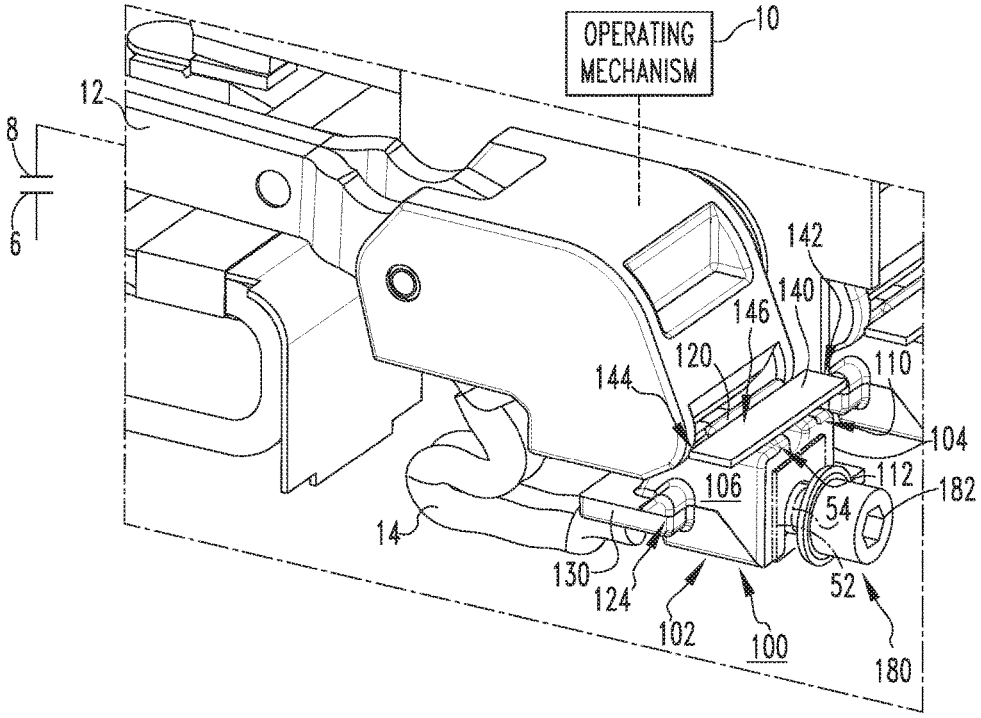
FIG. 5 is an enlarged isometric view of the shunt tab assembly of FIG. 4.

Continuing to refer to FIG. 1, and also to FIGS. 2-5, the shunt tab assembly 100 includes a shunt tab 102, which is electrically connected to the aforementioned shunts 14 (FIGS. 1, 2, and 5). A biasing element, which in the example shown and described herein is a leaf spring 140, biases the shunt tab 102 toward a predetermined desired position with respect to the circuit breaker housing 4, and a fastener 180 mechanically couples and electrically connects the trip unit 50 (FIG. 1) to the shunt tab 102 (see, for example, FIGS. 5 and 6 partially showing a portion of the trip unit 50 in simplified form in phantom line drawing).

More specifically, as shown in FIGS. 3 and 4, the circuit breaker housing 4 preferably includes a number of vertical elements 16,18 (e.g., without limitation, molded portions or vertical wall segments structured to form compartments for poles of the circuit breaker 2. The shunt tab 102 is structured to be movably disposed between a corresponding pair of the vertical elements 16,18, as best shown in FIG. 4. The aforementioned leaf spring 140 is structured to also extend between such pair of vertical elements 16,18. That is, the leaf spring 140 preferably includes first and second opposing ends 142,144 and a planar intermediate portion 146 extending therebetween. The vertical elements 16,18 in the example shown and described herein, include a first vertical element 16 having a first molded projection 20 and a second vertical element 18 having a second molded projection 22, which is disposed opposite and spaced from the first molded projection 20. The first end 142 of the leaf spring 140 is structured to be retained (e.g., beneath from the perspective of FIG. 4) by the first molded projection 20 and the second end 144 of the leaf spring 14 is structured to be retained by the second molded projection 22, as best shown in FIG. 4. The planar intermediate portion 146 of the leaf spring 140 engages and biases the shunt tab 102 (e.g., downward from the perspective of FIG. 4). It will be appreciated that the circuit breaker 2 may include any known or suitable number and/or configuration of shunt tab assemblies 100. For example and without limitation, three shunt tab assemblies 100 are shown in the non-limiting example of a three-pole circuit breaker 2 as illustrated and described herein. It will be appreciated that although only one shunt tab assembly 100 is described in detail herein for ease of illustration and economy of disclosure, the other shunt tab assemblies 100 may be substantially identical.

Figure 6:
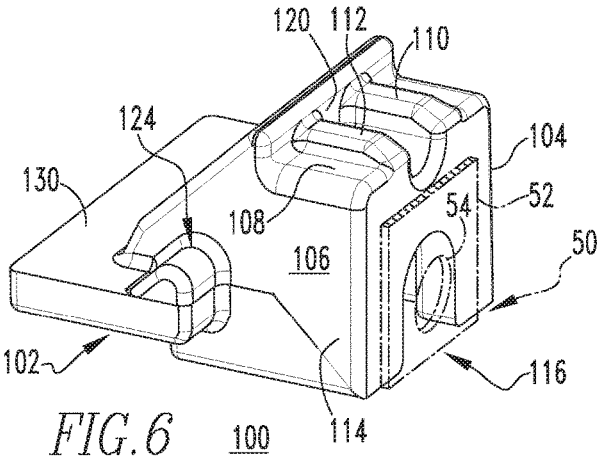
FIG. 6 is a top isometric view of a portion of the shunt tab assembly of FIG. 5.

As best shown in FIGS. 5 and 6, the shunt tab 102 of the example shunt tab assembly 100 includes first and second opposing sides 104,106, and a body portion 108 extending therebetween. The first side 104 is structured to be disposed proximate the first vertical element 16 of the circuit breaker housing 4 and the second side 106 is structured to be disposed proximate the second vertical element 18 of the circuit breaker housing 4 (see also FIG. 4). The body portion 108 preferably includes a number of protrusions (two protrusions 110,112 are shown in the non-limiting example illustrated and described herein), which extend outwardly (e.g., upward from the perspective of FIGS. 4-6) from the body portion 108, as best shown in FIG. 6. Accordingly, the planar intermediate portion 146 of the leaf spring 140 is designed to compress against such protrusions 110,112, thereby biasing the shunt tab 102 toward the desired predetermined position (e.g., downward from the perspective of FIGS. 4 and 5) with respect to the housing, as shown in FIG. 5.

Figure 7:
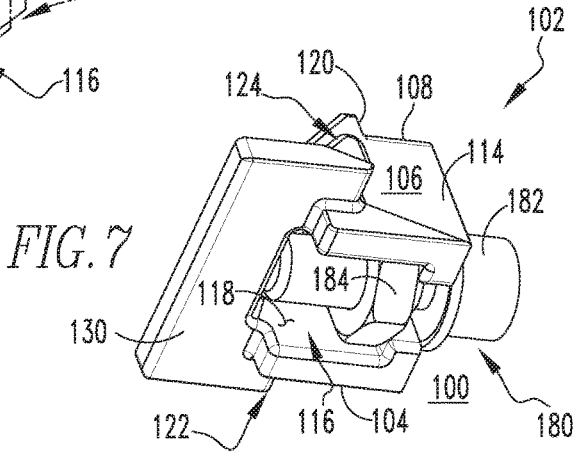
FIG. 7 is a bottom isometric view of the portion of the shunt tab assembly of FIG. 6.

Referring again to FIG. 5, as well as FIGS. 6 and 7, it will be appreciated that the example shunt tab 102 preferably further includes an elongated retention edge 120. The elongated retention edge 120 is designed to cooperate with the planar intermediate portion 146 of the leaf spring 140, as shown for example in FIG. 5, in order to retain (e.g., maintain) the leaf spring 140 in a desired position with the respect to the shunt tab 102.

As best shown in FIGS. 6 and 7, the shunt tab 102 is preferably made (e.g., without limitation, machined, cast or forged) from a single piece of electrically conductive material (e.g., without limitation, copper) and comprises an exterior 114 an interior 116, and a cavity 118 that extends from the exterior 114 to the interior 116, as best shown in FIG. 7. The fastener 180 in the example shown and described herein comprises a mounting bolt 182 and a corresponding nut 184, which as shown in FIG. 7, is retained within the cavity 118. Accordingly, the mounting bolt 182 is structured to extend from the exterior 114 of the shunt tab 102 to the interior 116 of the shunt tab 102 to engage the nut 184. In this manner, the fastener 180 fastens the trip unit 50 to the shunt tab 102. That is, the trip unit 50 includes at least one mounting tab 52 (partially shown in simplified form in phantom line drawing in FIGS. 5 and 6), which has a mounting hole 54. The mounting bolt 182 extends through the mounting hole 54 and fastens to the nut 184 within the cavity 118, thereby mechanically coupling and electrically connecting the mounting tab 52 of the trip unit 50 on the exterior 114 of the shunt tab 102.

Among other advantages, this unique design, wherein the nut 184 is disposed within the cavity 118 of the shunt tab 102 overcomes known dielectric issues with prior art shunt tab assembly designs (not shown). That is, by using the nut 184 retained within the cavity 118 of the shunt tab 102, the necessity to tap (e.g., without limitation, thread) a conductive member (e.g., without limitation copper block) in accordance with the prior art, is eliminated. This not only makes for a stronger bolted joint (see, for example, FIG. 7), but it also addresses and overcomes issues associated with insufficient dielectric spacing. More specifically, the use of the leaf spring 140 to bias the shunt tab 102, in combination with the elimination of requiring mounting screws (not shown) extending through the circuit breaker housing to be threaded into the copper block (not shown), in accordance with the prior art, eliminates closely positioned and other components fasteners that are electrically conductive and can cause undesirable dielectric issues. That is, the leaf spring 140 in accordance with the disclosed concept serves to suitably bias the shunt tab 102 to the desired position within the circuit breaker housing 4 (FIGS. 1-4), thereby eliminating the need for such separate mounting screws or other fasteners. This, in turn, eliminates undesirable associated dielectric issues caused thereby.

The single piece electrically conducted piece 102 of the non-limiting example shunt tab assembly 100 further includes pivot points 122,124 (both shown in FIGS. 2 and 7) and a flange 130, which extends laterally between the opposing pivot points 122,124. The opposing pivot points 122,124 are structured to cooperate with circuit breaker housing 4 in order to allow the shunt tab 102 to pivot or otherwise move with respect to the housing 4, as desired (see, for example, FIGS. 2-4). The flange 130 is structured to provide a suitably surface to which the aforementioned shunts 14 (FIGS. 1, 2, and 5) can be connected (e.g., without limitation, soldered or welded) to the shunt tab 102.

Accordingly, it will be appreciated, that the disclosed shunt tab assembly 100 provides a unique leaf spring 140 and shunt tab 102 design whereby the leaf spring 140 biases the shunt tab 102 to a predetermined desired orientation with respect to the circuit breaker housing 4, thereby eliminating the requirement for separate mounting screws to be inserted through the circuit breaker housing 4 to secure the shunt tab 102. This, in turn, offers a number of benefits, including avoiding undesirable dielectric issues caused by closely spaced electrically conductive components. Additionally, the unique fastener 180 in accordance with the disclosed concept, whereby the nut 184 is retained within the cavity 118 of the shunt tab 102 and serves as a stable fastening point for the corresponding mounting bolt 182, advantageously establishes a stronger bolted joint between the trip unit 50 and shunt tab assembly 100 compared to prior art threaded (e.g., without limitation, tapped) copper block designs.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A shunt tab assembly for an electrical switching apparatus, said electrical switching apparatus including a housing, separable contacts enclosed by the housing, an operating mechanism for opening and closing said separable contacts, and a number of shunts, said operating mechanism including a trip unit, said shunt tab assembly comprising:

a shunt tab structured to be electrically connected to said shunts;

a biasing element structured to bias said shunt tab toward a predetermined position with respect to the housing; and a fastener structured to mechanically couple and electrically connect said trip unit to said shunt tab, wherein said biasing element is a leaf spring; and wherein said leaf spring is structured to cooperate with the housing of said electrical switching apparatus to bias said shunt tab toward said predetermined position, wherein the housing of said electrical switching apparatus comprises a plurality of vertical elements; wherein said shunt tab is structured to be disposed between a corresponding pair of said vertical elements; and wherein said leaf spring is structured to extend between said corresponding pair of said vertical elements, and wherein said leaf spring comprises a first end, a second end disposed opposite and distal from the first end, and a planar intermediate portion extending between the first end and the second end; wherein said plurality of vertical elements comprises a first vertical element including a first molded projection and a second vertical element including a second molded projection disposed opposite and spaced from said first molded projection; wherein the first end of said leaf spring is structured to be retained by said first molded projection; wherein the second end of said leaf spring is structured to be retained by said second molded projection; and wherein the planar intermediate portion of said leaf spring engages and biases said shunt tab.

2. The shunt tab assembly of claim 1 wherein said shunt tab comprises a first side structured to be disposed proximate said first vertical element, a second side structured to be disposed proximate said second vertical element, a body portion extending between the first side and the second side, and a number of protrusions extending outwardly from said body portion; and wherein the planar intermediate portion of said leaf spring is compressed against said protrusions, thereby biasing said shunt tab toward said predetermined position.

3. The shunt tab assembly of claim 1 wherein said shunt tab comprises an elongated retention edge; and wherein said elongated retention edge cooperates with the planar intermediate portion of said leaf spring in order to retain said leaf spring in position with respect to said shunt tab.

4. The shunt tab assembly of claim 1 wherein said shunt tab is a single piece electrically conductive member comprising an exterior, an interior, and a cavity extending from the exterior to the interior.

5. A shunt tab assembly for an electrical switching apparatus, said electrical switching apparatus including a housing, separable contacts enclosed by the housing, an operating mechanism for opening and closing said separable contacts, and a number of shunts, said operating mechanism including a trip unit, said shunt tab assembly comprising:

a shunt tab structured to be electrically connected to said shunts;

a biasing element structured to bias said shunt tab toward a predetermined position with respect to the housing; and a fastener structured to mechanically couple and electrically connect said trip unit to said shunt tab, wherein said shunt tab is a single piece electrically conductive member comprising an exterior, an interior, and a cavity extending from the exterior to the interior, and wherein said fastener comprises a mounting bolt and a corresponding nut; wherein said nut is retained within said cavity; and wherein said mounting bolt extends from the exterior of said shunt tab to the interior of said shunt tab to engage said nut.

6. The shunt tab assembly of claim 5 wherein said trip unit includes at least one mounting tab having a mounting hole; and wherein said mounting bolt is structured to extend through said mounting hole and fasten to said nut to mechanically couple and electrically connect said mounting tab of said trip unit to said shunt tab.

7. A shunt tab assembly for an electrical switching apparatus, said electrical switching apparatus including a housing, separable contacts enclosed by the housing, an operating mechanism for opening and closing said separable contacts, and a number of shunts, said operating mechanism including a trip unit, said shunt tab assembly comprising:

a shunt tab structured to be electrically connected to said shunts;

a biasing element structured to bias said shunt tab toward a predetermined position with respect to the housing; and a fastener structured to mechanically couple and electrically connect said trip unit to said shunt tab, wherein said shunt tab is a single piece electrically conductive member comprising an exterior, an interior, and a cavity extending from the exterior to the interior, and wherein said single piece electrically conductive member further comprises opposing pivot points and a flange extending laterally between said opposing pivot points; wherein said opposing pivot points are structured to cooperate with the housing of said electrical switching apparatus; and wherein said flange is structured to be electrically connected to said shunts.

8. An electrical switching apparatus comprising:

a housing;

separable contacts enclosed by the housing;

an operating mechanism for opening and closing said separable contacts, said operating mechanism including a trip unit;

a number of shunts; and at least one shunt tab assembly comprising:

a shunt tab electrically connected to said shunts, a biasing element biasing said shunt tab toward a predetermined position with respect to the housing, and a fastener mechanically coupling and electrically connecting said trip unit to said shunt tab, wherein said biasing element is a leaf spring; and wherein said leaf spring cooperates with the housing to bias said shunt tab toward said predetermined position, wherein the housing comprises a plurality of vertical elements; wherein said shunt tab is disposed between a corresponding pair of said vertical elements; and wherein said leaf spring extends between said corresponding pair of said vertical elements, and wherein said leaf spring comprises a first end, a second end disposed opposite and distal from the first end, and a planar intermediate portion extending between the first end and the second end; wherein said plurality of vertical elements comprises a first vertical element including a first molded projection and a second vertical element including a second molded projection disposed opposite and spaced from said first molded projection; wherein the first end of said leaf spring is retained by said first molded projection; wherein the second end of said leaf spring is retained by said second molded projection; and wherein the planar intermediate portion of said leaf spring engages and biases said shunt tab.

9. The electrical switching apparatus of claim 8 wherein said shunt tab comprises a first side disposed proximate said first vertical element, a second side disposed proximate said second vertical element, a body portion extending between the first side and the second side, and a number of protrusions extending outwardly from said body portion; and wherein the planar intermediate portion of said leaf spring is compressed against said protrusions, thereby biasing said shunt tab toward said predetermined position.

10. The electrical switching apparatus of claim 8 wherein said shunt tab comprises an elongated retention edge; and wherein said elongated retention edge cooperates with the planar intermediate portion of said leaf spring in order to retain said leaf spring in position with respect to said shunt tab.

11. The electrical switching apparatus of claim 8 wherein said shunt tab is a single piece electrically conductive member comprising an exterior, an interior, and a cavity extending from the exterior to the interior.

12. The electrical switching apparatus of claim 8 wherein said electrical switching apparatus is a circuit breaker; wherein said circuit breaker includes a plurality of poles; and wherein said at least one shunt tab assembly is a plurality of shunt tab assemblies each corresponding to one of the poles of the circuit breaker.

13. An electrical switching apparatus comprising:

a housing;

separable contacts enclosed by the housing;

an operating mechanism for opening and closing said separable contacts, said operating mechanism including a trip unit;

a number of shunts; and at least one shunt tab assembly comprising:

a shunt tab electrically connected to said shunts, a biasing element biasing said shunt tab toward a predetermined position with respect to the housing, and a fastener mechanically coupling and electrically connecting said trip unit to said shunt tab, wherein said shunt tab is a single piece electrically conductive member comprising an exterior, an interior, and a cavity extending from the exterior to the interior, and wherein said trip unit includes at least one mounting tab having a mounting hole; wherein said fastener comprises a mounting bolt and a corresponding nut; wherein said nut is retained within said cavity; and wherein said mounting bolt extends through the mounting hole of a corresponding one of said at least one mounting tab of said trip unit to the interior of said shunt tab to engage said nut, thereby mechanically coupling and electrically connecting said mounting tab to the exterior of said shunt tab.

14. The electrical switching apparatus of claim 13 wherein said electrical switching apparatus is a circuit breaker; wherein said circuit breaker includes a plurality of poles; and wherein said at least one shunt tab assembly is a plurality of shunt tab assemblies each corresponding to one of the poles of the circuit breaker.

15. An electrical switching apparatus comprising:

a housing;

separable contacts enclosed by the housing;

an operating mechanism for opening and closing said separable contacts, said operating mechanism including a trip unit;

a number of shunts; and at least one shunt tab assembly comprising:

a shunt tab electrically connected to said shunts, a biasing element biasing said shunt tab toward a predetermined position with respect to the housing, and a fastener mechanically coupling and electrically connecting said trip unit to said shunt tab, wherein said shunt tab is a single piece electrically conductive member comprising an exterior, an interior, and a cavity extending from the exterior to the interior, and wherein said single piece electrically conductive member further comprises opposing pivot points and a flange extending laterally between said opposing pivot points; wherein said opposing pivot points cooperate with the housing of said electrical switching apparatus; and wherein said flange is electrically connected to said shunts.

16. The electrical switching apparatus of claim 15 wherein said electrical switching apparatus is a circuit breaker; wherein said circuit breaker includes a plurality of poles; and wherein said at least one shunt tab assembly is a plurality of shunt tab assemblies each corresponding to one of the poles of the circuit breaker.

* * * * *